US010934139B2

(12) United States Patent
Assmann

(10) Patent No.: US 10,934,139 B2
(45) Date of Patent: Mar. 2, 2021

(54) LIFTING APPARATUS

(71) Applicant: CEMTEC CEMENT AND MINING TECHNOLOGY GMBH, Enns (AT)

(72) Inventor: Roland Heinz Assmann, Büdingen (DE)

(73) Assignee: CEMTEC CEMENT AND MINING TECHNOLOGY GMBH, Enns (AT)

( * ) Notice: Subject to any disclaimer, the term of this patent is extended or adjusted under 35 U.S.C. 154(b) by 212 days.

(21) Appl. No.: 16/077,644

(22) PCT Filed: Feb. 9, 2017

(86) PCT No.: PCT/EP2017/000182
§ 371 (c)(1),
(2) Date: Aug. 13, 2018

(87) PCT Pub. No.: WO2017/137163
PCT Pub. Date: Aug. 17, 2017

(65) Prior Publication Data

US 2019/0031478 A1 Jan. 31, 2019

(30) Foreign Application Priority Data

Feb. 13, 2016 (DE) ..... 10 2016 001 695.7

(51) Int. Cl.
*B66C 19/00* (2006.01)
*B66C 13/06* (2006.01)
*B66F 7/06* (2006.01)

(52) U.S. Cl.
CPC ..... *B66C 19/00* (2013.01); *B66C 13/06* (2013.01); *B66F 7/0616* (2013.01)

(58) Field of Classification Search
CPC ..... B66C 13/00; B66C 13/06; B66C 13/063; B66C 17/00; B66C 17/06; B66C 19/00;
(Continued)

(56) References Cited

U.S. PATENT DOCUMENTS 2,271,428 A * 1/1942 Harry ..... B66C 7/00 254/290
2,271,429 A * 1/1942 Harry ..... B66C 7/00 254/290

(Continued)

FOREIGN PATENT DOCUMENTS

CN 201801309 U 4/2011
DE 2241475 A1 3/1974

(Continued)

*Primary Examiner* — Michael R Mansen
*Assistant Examiner* — Juan J Campos, Jr.
(74) *Attorney, Agent, or Firm* — Lucas & Mercanti, LLP; Klaus P. Stoffel

(57) ABSTRACT

A lifting apparatus, including a support carriage movable along a track, a lifting element for holding a load, a lifting device for raising and lowering the lifting element vertically relative to the support carriage. The lifting device includes at least two tension elements, wherein each tension element can be wound onto the supporting carriage by a winding apparatus. A first drive is provided for driving a first winding apparatus and a second drive is provided for driving a second winding apparatus. The first drive has a drive motor which drives a shaft by a conical gear mechanism, the shaft drives a roller of the first winding apparatus by a gear mechanism element and the second drive has a drive motor which drives a roller of the second winding apparatus by a spur gear, parallel-shaft gear or planetary gear mechanism.

11 Claims, 9 Drawing Sheets

(58) Field of Classification Search
CPC ... B66D 1/26; B66D 1/34; B66D 1/66; B66D 1/7447; B66B 11/08; B66B 11/008
USPC ..... 254/278, 290; 104/87–105
See application file for complete search history.

(56) References Cited

U.S. PATENT DOCUMENTS

| | | | | |
|---|---|---|---|---|
| 5,553,335 | A * | 9/1996 | Lahtinen | A61G 7/1015 212/97 |
| 5,673,804 | A | 10/1997 | Weiss et al. | |
| 5,765,703 | A * | 6/1998 | Shiwaku | B66C 13/08 212/274 |
| 6,991,064 | B2 | 1/2006 | Ehrenleitner | |
| 7,128,226 | B2 | 10/2006 | Assmann | |
| 7,284,744 | B1 * | 10/2007 | Lerchenmueller | B66C 13/06 254/278 |
| 7,357,376 | B2 | 4/2008 | Assmann | |
| 2004/0101393 | A1 * | 5/2004 | Lopez Alba | B66C 13/06 414/680 |
| 2013/0134120 | A1 * | 5/2013 | Won | H01L 21/67736 212/328 |
| 2013/0264301 | A1 * | 10/2013 | Kim | B66C 19/00 212/71 |
| 2015/0090684 | A1 * | 4/2015 | Liao | H01L 21/68742 212/276 |

FOREIGN PATENT DOCUMENTS

| | | | |
|---|---|---|---|
| DE | 2523417 | A1 | 12/1976 |
| DE | 4326673 | A1 | 6/1997 |
| DE | 19957468 | A1 | 6/2001 |
| DE | 10132350 | A1 | 1/2003 |
| DE | 69719001 | T2 | 10/2003 |
| DE | 10217161 | A1 | 11/2003 |
| DE | 10257108 | A1 | 7/2004 |
| EP | 1794078 | B1 | 11/2008 |
| FR | 2295904 | A | 7/1976 |
| FR | 2757441 | A1 | 6/1998 |
| JP | S62295898 | A | 12/1987 |
| JP | H06336393 | A | 12/1994 |
| JP | H07215665 | A | 8/1995 |

* cited by examiner

LIFTING APPARATUS

CROSS-REFERENCE TO RELATED APPLICATION

The present application is a 371 of International application PCT/EP2017/000182, filed Feb. 9, 2017, which claims priority of DE 10 2016 001 695.7, filed Feb. 13, 2016, the priority of these applications is hereby claimed and these applications are incorporated herein by reference.

BACKGROUND OF THE INVENTION

The invention relates to a lifting apparatus, comprising a support carriage which can be moved along a track, a lifting element for holding a load, a lifting device with which the lifting element can be raised and lowered in the vertical direction relative to the supporting carriage, wherein the lifting device comprises at least two, preferably four, tension elements, wherein each tension element is fixed with one end at the lifting element and at the supporting carriage and can be wound by means of each one winding apparatus onto the supporting carriage or onto the lifting element, wherein each tension element is designed as plane sheet and each winding apparatus comprises at least one roller by which the tension element can be wound, wherein each tension element comprises a thickness and a width, wherein the width is at least 100 times of the thickness, wherein at least one first winding apparatus and at least one second winding apparatus is given, wherein a roller of the first winding apparatus and a roller of the second winding apparatus have axes of rotation which are arranged perpendicular to another.

A device of the generic kind is known from DE 43 26 673 A1. Similar and further solutions are shown in DE 697 19 001 T2, in FR 2 757 441 A1, in DE 101 32 350 A1 and in DE 102 57 108 A1. With such a device for example parts of vehicles can be conveyed along an electric suspension track, wherein the height above ground of the part which has to be transported can be adjusted. As tension element chains or ropes are used which are wound on respective rope drums or a lifting unit for chains to adjust the height over ground of the part of the vehicle. For the stabilisation of the lifting element relatively to the supporting carriage a separate device is used. This pre-known solution has detrimentally a relatively high installation length and has a relatively high weight. Furthermore, the position of the lifting element is varying with the lift height.

A further solution shows EP 1 794 078 B1. Also this device has a relatively high installation length and a high weight. The design is relatively complex and offers a plurality of possibilities for adjustment. Furthermore, a relatively elaborate manufacturing and assembly of the device as well as a poor accessibility for the purpose of maintenance are detrimental. Also here, as in the case of the pre-known solution, the lifting device as well as the stabilisation device are separately designed.

A further similar solution is described in DE 199 57 468 A1. Here, similar disadvantages are given as in the case of the above described device. Furthermore, the flexibility is limited.

SUMMARY OF THE INVENTION

Thus, it is the object of the present invention to further develop a device of the above mentioned kind so that a light and universally usable lifting device of the generic kind is created which has compact dimensions and allows a stable guidance of the lifting device relatively to the supporting carriage. Furthermore, the concept which is used should be substantially independent from the lift height and the application.

The solution of this object according to the invention is characterized in that a first drive is present for driving of the at least one first winding apparatus and a second drive for driving of the at least one second winding apparatus, wherein the first drive comprises a drive motor which drives at least one shaft via an conical gear mechanism, preferably via a bevel gear, which shaft drives a roller of the first winding apparatus via a gear mechanism element and wherein the second drive comprises a drive motor which drives a roller of the second winding apparatus via a spur gear, a parallel-shaft gear or a planetary gear mechanism.

Preferably, the width is at least 200 times, specifically preferred at least 300 times and very specifically preferred at least 500 times of the thickness. However, often the width is at least 1,000 times of the thickness.

With this specification it is defined that as tension element a band-shaped structure should be employed which is correspondingly differentiated to the pre-known solutions with ropes of chains, eventually also with small belts. Thus, as tension elements for example wide flat belts and other plane designed and sheets which can be wound respectively are used, which are especially flexible, Thereby, also the possibility is given that the tension elements do not have a constant width along the whole used height to meet requirements with respect to the design. Insofar, for example the possibility is given that the tension elements are enlarged in the width especially at one of their ends. Furthermore, the possibility is given that the tension elements do not have a constant thickness along the whole used height. So, the tension element can for example be reinforced at the fixation of the end and thus thicker as in the remaining region, The basis for the mentioned width-thickness ratio is insofar the plane base material of the tension element.

A further preferred embodiment of the invention provides that the width of the tension elements is selected in dependence of the outer dimensions of the supporting carriage and the lifting element respectively. Accordingly the width of the tension elements is at least 50% of the outer dimensions of the supporting carriage and/or of the lifting element at the location of the tension element, Respective optimal values for the width of the tension element are between 50% and 100% of said outer dimension. Especially at the use of drums with integrated drive the upper region can be easily realized.

Preferably four winding apparatus are present, wherein respectively the roller of two winding apparatus have axes of rotation which are arranged parallel to another and wherein the axes of rotation of the rollers of two winding apparatus are perpendicular to the axis of rotation of the rollers of the two further winding apparatus, Thereby it is preferably provided that the first drive for driving of two winding apparatus and the second drive for driving of two further winding apparatus are present.

Another preferred embodiment of the invention provides that three winding apparatus are present, wherein two rollers of the first and second winding apparatus have axes of rotation which are arranged parallel to another and the axis of rotation of the roller of the third winding apparatus is arranged perpendicular to the axis of rotation of the first and second winding apparatus. In this case the rollers of the first and second winding apparatus and the roller of the third winding apparatus form preferably a H-shaped structure in the top plan view.

The tension elements consist according to a preferred embodiment of the invention of textile material, especially of a textile sheet, or of metal, especially of a metal sheet or of a netting.

A further preferred embodiment of the invention provides that between the first drive and the second drive a synchronization element is arranged for a synchronal movement of the two drives. When using an electronic shaft and drum motors with integrated drive also four drives are conceivable. The same applies for four slip on gear mechanisms.

The gear mechanism element is thereby preferably a belt drive or a chain drive.

The spur gear is thereby preferably a parallel-shaft gear.

Between the spur gear and the two rollers of the winding apparatus preferably at least each one gear element is arranged, especially a belt drive or a chain drive. Thereby, spur gears and parallel-shaft gears can be employed selectively which comprise respectively shafts with parallel axes.

Thus, the present invention aims for the creation of a beneficial liftable hanger of an electrical suspension track by which it is possible to lift loads in a stable manner, wherein primary parts of vehicles (autobodies, engines) are concerned which must be conveyed into assembly lines; however also other applications are possible, for example lifting devices for containers.

At the supporting carriage a suitable reception element is fixed, for example a 4-arm hanger or a 2-arm hanger with respective reception regions for the part to be carried (e.g. autobody reception), Here also elements can be provided which allow a pivoting of the part to be conveyed around the desired axes.

Accordingly, the present invention concerns thus a device for lifting and stabilizing of loads, especially a hanger for vehicles or parts of vehicles, comprising a supporting carriage (upper frame) as well as a lifting element (lower frame) which is arranged below it, a load reception device for receiving the load which is adjustable in height by means of preferably wide belts or textiles (tension elements) which are fixed at the lower frame and which can be raised or lowered by means of at least two (respectively due to safety reasons preferably at least three) rollers (drums)—which are in the case of three or four rollers are especially arranged orthogonally to another. By doing so it is provided that the lower frame is stabilized in the position relatively to the upper frame due to a membrane effect of the belts and textiles respectively which is namely obtained that the belts and textiles respectively (tension elements) have a sufficient width which goes far beyond the pure lifting function and so no further mechanical stabilisation device, like scissor type supports, telescopes etc., is required to stabilize the relative movement of the lower frame to the upper frame in horizontal direction.

The device is thereby especially coupled to movable devices, e. g. to an electric suspension track, a so-called "Power & Free" conveyor or to hanging platforms, so that autonomic self-driving units are created.

The fixation of the tension element (belts) at the lower frame takes place preferably statically determined so that an equal and defined respectively distribution of the load onto the tension elements (belts and textiles respectively) is obtained.

The tension elements can also be realized by a wide thin metal band or metal mesh.

The lifting means can be equipped with vertical and diagonal tie beams for a specific force transmission. They can be supplied with a sliding layer and/or a wear resistant layer.

The lifting means can be supplied with one or several conical, circular or rectangular guiding grooves for centering.

Due to safety reasons and due to reasons of flexibility respectively also several layers can be employed at the tension elements.

The rollers (drums) for winding of the tension elements can be designed crowned and/or supplied with conical ends to ensure a centric winding of the tension elements.

For ensuring of a synchronic lifting operation the rollers (drums) can be mechanically coupled with another.

Furthermore, it can be provided that a coupling of the lifting drives takes place on the input side for the reduction of the torques, The single rollers (drums) can be driven individually but can also be coupled with another by a so-called electronic shaft.

The drive and the drives respectively for the rollers can also be integrated in the same.

The lower frame can be supplied with a changing adapter which allows the reception of different hangers.

The receptions for the hangers can thereby also be designed according to an embodiment in such a manner that they can be swivelled out laterally.

Also, an embodiment is possible in such a manner that the load which has to be carried can be pivoted around its longitudinal or vertical axis.

The lifting device can furthermore be equipped with one or more safety brakes.

Furthermore, a device for measuring the load or to limit the load can be integrated. Also the lifting means can be equipped with a load measuring device.

As a specifically preferred embodiment of the invention an orthogonal arrangement of the rollers (lifting drums) in combination with one or more spur gears, parallel-shaft gears or planetary gear mechanisms and/or with one or more conical gear mechanisms for their drive is possible. By doing so it can be done without a separate conical gear mechanism.

The single parts of the proposed device, e. g. the lifting drums, can be manufactured from light weight construction materials like aluminum, GRP or carbon.

The transmissions can reduce the torques of the drives by a respective speed transformation and thus act like being reeved. The lifting means for the reduction of the torque of the lifting drives can thereby once or multiple reeved.

Furthermore, the device can be provided with a survey of the lift height. The lifting means can furthermore be printed with an optical display for the survey of the lift height.

Furthermore, the lifting means can be printed permanently or temporary with additional information, e. g. concerning assembly steps, vehicle type.

The lifting means can also be provided with illumination means and/or with a reflecting layer and so contribute to the illuminating the working areas.

The upper and/or lower frame can be designed walkable to facilitate maintenance.

Thus, the propose solution allows a compact and light construction by an aggregation of carriage means and stabilisation device as well as by the drive-technical integration of the lifting device into the upper frame. The preferably three or four tension elements are each especially designed as wide thin winding belts and are wound onto three rollers being arranged H-shaped or on four rollers being arranged all around. A carbon design of the rollers allows a further reduction of weight without a detrimental influence of the life period or of the stability.

The stabilizing effect occurs via a membrane effect of the tension elements which is created by the own weight of the lower frame as well as by the load which has to be carried, Different lengths of stroke which are adapted to the respective application can be realized in an easy manner by an extension or reduction of the tension elements without changing or adapting the base construction of the proposed device. This allows the realization of a high standardization degree, a request which is always raised specifically in the automobile industry. The number of tension element is clear with three or four, wherein each two tension elements or combinations of tension elements are arranged redundant and can take over the safeguard of the complete load at an outfall of a tension element or of a drive train. Furthermore, preferably a parallel-shaft gear drive and a spur gear drive and a conical gear mechanism drive respectively are combined for the actuation of the lifting device. So, beside a redundancy also a diversity of the drive train is obtained which further increases the safety. The two drives are coupled at the primary side preferably via an elastic or a cardanic shaft. This ensures that both drive run synchronal. Here in the given case also a limitation of the lowering velocity can be provided, e. g. by means of a centrifugal brake, and/or an additional safety brake can be provided. By the coupling on the primary side the torques remain low which is positive with respect to the dimensioning of the force-transmitting parts and the safety elements respectively and also contributes to a reduction of weight.

The force transmission between drives and winding rollers allows the introduction of an additional gear ratio. Thereby and by a relatively small diameter of the winding rollers the required driving torque onto the lifting drives is reduced so that those can be reduced in the gear size and thus in weight.

To facilitate the adjustment and to ensure a permanent safe operation it can be considered to design the force application of the plane belts into the lower frame statically determined. By doing so it is ensured that always all (preferably) three or four plane belts are equally loaded.

2-arm hangers, 4-arm hangers, swivel arms as well as a swivel frames can be adapted at the lower frame. The solution can be integrated in stationary devices as well as also in different conveyor concepts. So, single lane as well as dual lane electrical suspension tracks can be considered. Also the device could be integrated in so-called "Power & Free" devices or hanging pushing platform concepts.

Furthermore, it can be considered to arrange safety shut-off mats or step plates in the lower and/or upper frame to improve the accessibility for maintenance work. Because the lower frame does not comprise otherwise due to its concept any installations in the inner region, as the case may be a lifting ramp which is dimensioned accordingly can be brought in between the reception traverses whereby maintenance work at the lifting apparatus can be facilitated significantly—especially in distinction to the pre-known solutions.

As mentioned the axes of rotation of the rollers of said winding apparatus are arranged perpendicular to another, Hereby, of course it has to be understood that said orthogonality is given in one of the views, especially in the top plan view of the device. Furthermore, it should be mentioned that also minor differences from the orthogonality are covered by the idea according to the invention, if thus for example the axes include an angle of only 87°.

BRIEF DESCRIPTION OF THE DRAWING

In the drawing embodiments of the invention are shown.

DETAILED DESCRIPTION OF THE INVENTION

Figure 1:
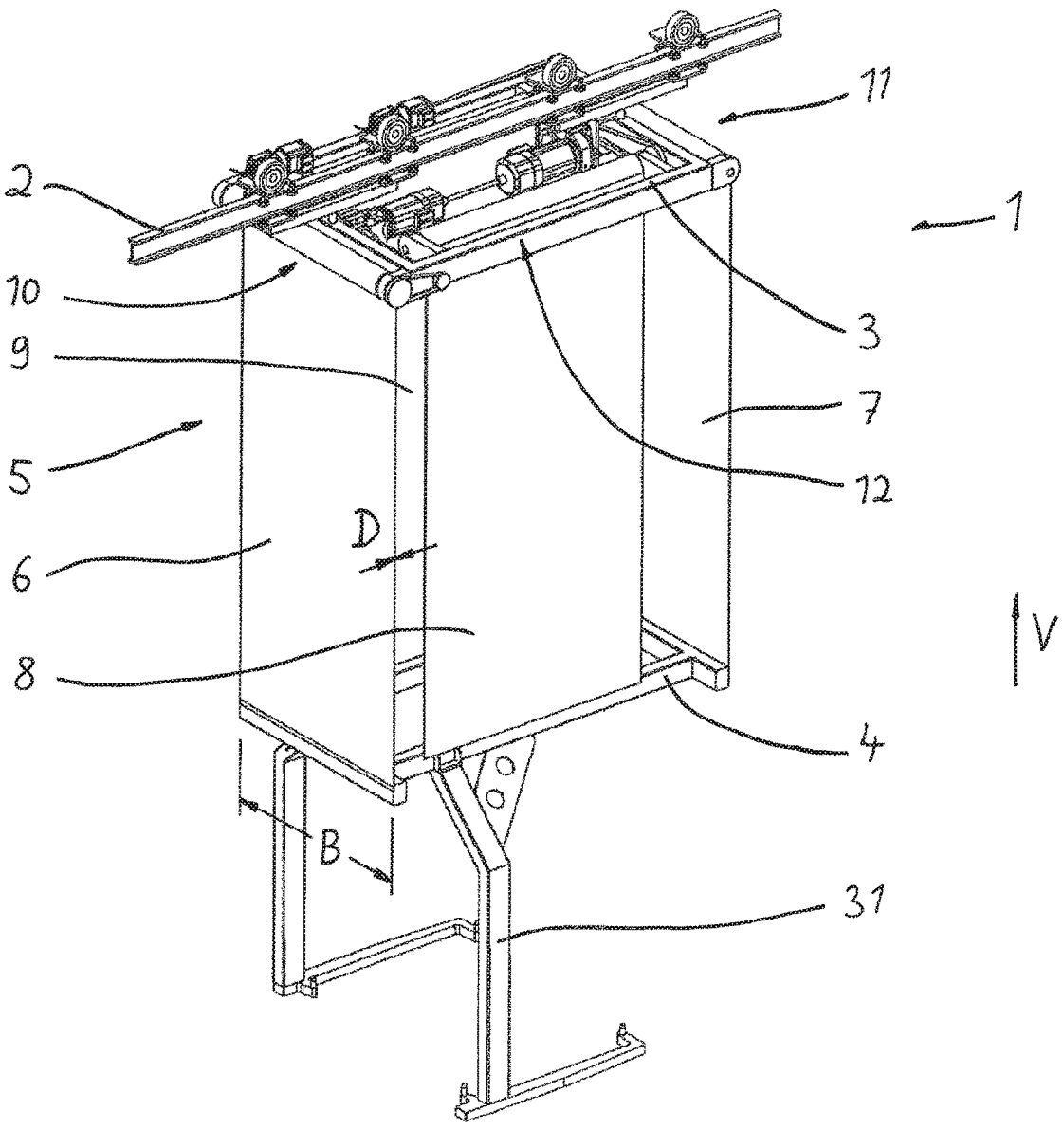
FIG. 1 shows in perspective view a lifting apparatus which is movable arranged along a path in horizontal direction, wherein one lifting element (lower frame) is arranged relatively to a supporting carriage (upper frame) in a lowered position.
Figure 2:
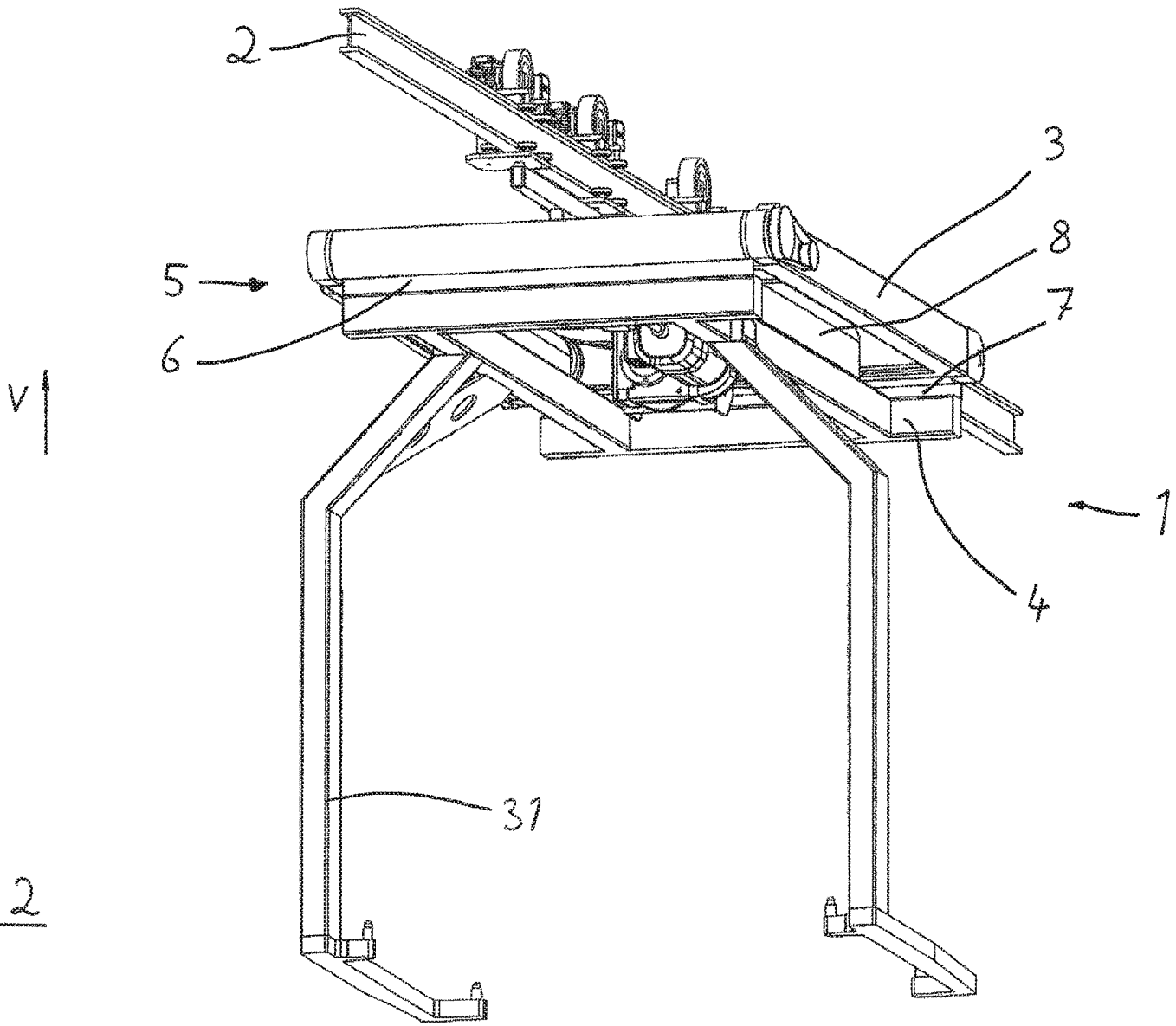
FIG. 2 shows in the depiction according to FIG. 1—however seen from a lower position—the lifting apparatus, wherein the lifting element is arranged relatively to the supporting carriage in a lifted position.

In the figures a lifting apparatus 1 is shown which is arranged movable in a horizontal direction along a track 2 being a rail. With the lifting apparatus 1 parts can be conveyed in horizontal direction wherefore the lifting apparatus 1 is moved along the track 2. Said movement can occur actively or passively, i.e. motorised or not motorised rollers can be provided in the region of the track 2.

The lifting apparatus 1 comprises substantially and upper arranged supporting carriage 3 (upper frame) and a lower arranged lifting element 4 (lower frame), wherein a lifting device 5 is provided to move the lifting element 4 in vertical direction V relatively to the supporting carriage 3, i.e. to lift or to drop it. A hanger 31 is fixed at the lifting element 4 which serves for the reception of a part, for example an autobody part.

Figure 4:
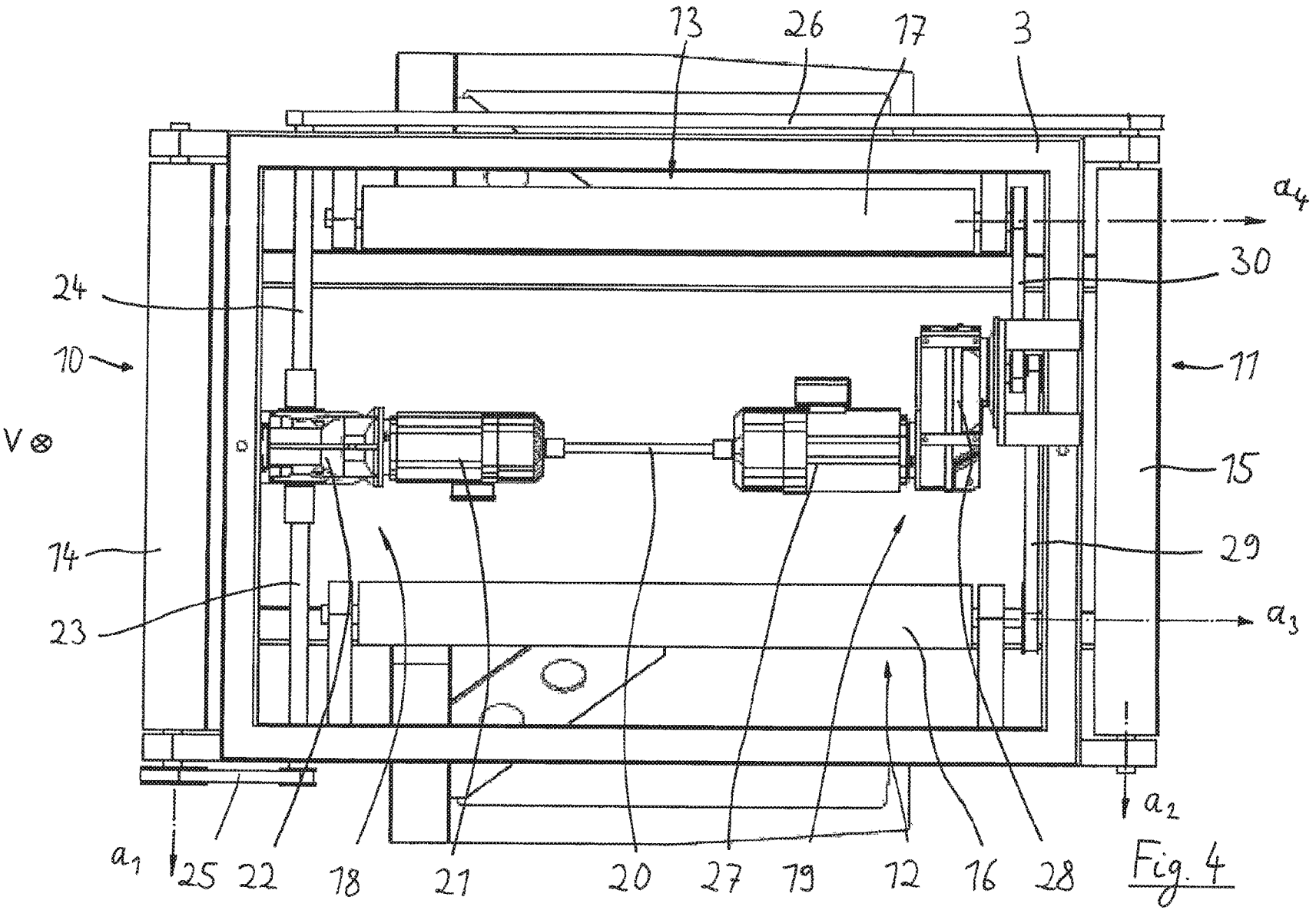
FIG. 4 shows the top plan view onto the arrangement according to FIG. 3.

The lifting device 5 comprises four winding devices 10, 11, 12 and 13 which comprise each a driven roller 14, 15, 16 and 17, wherein each roller 14, 15, 16, 17 winds or winds-up a tension element 6, 7, 8 and 9 when it is rotated around its respective axis of rotation $a_1$, $a_2$, $a_3$ and $a_4$ respectively (see for this FIG. 4).

The tensioning elements 6, 7, 8 and 9 are thereby designed as plane sheets and especially as wide belts which can consist for example of textile material or of a metallic netting. In FIG. 1 it is shown schematically that each tension element 6, 7, 8, 9 has a width B and a thickness D. To concretise the plane design of the tensioning elements said width is preferably at least 100 times of the thickness D, especially at least 500 times.

Figure 3:
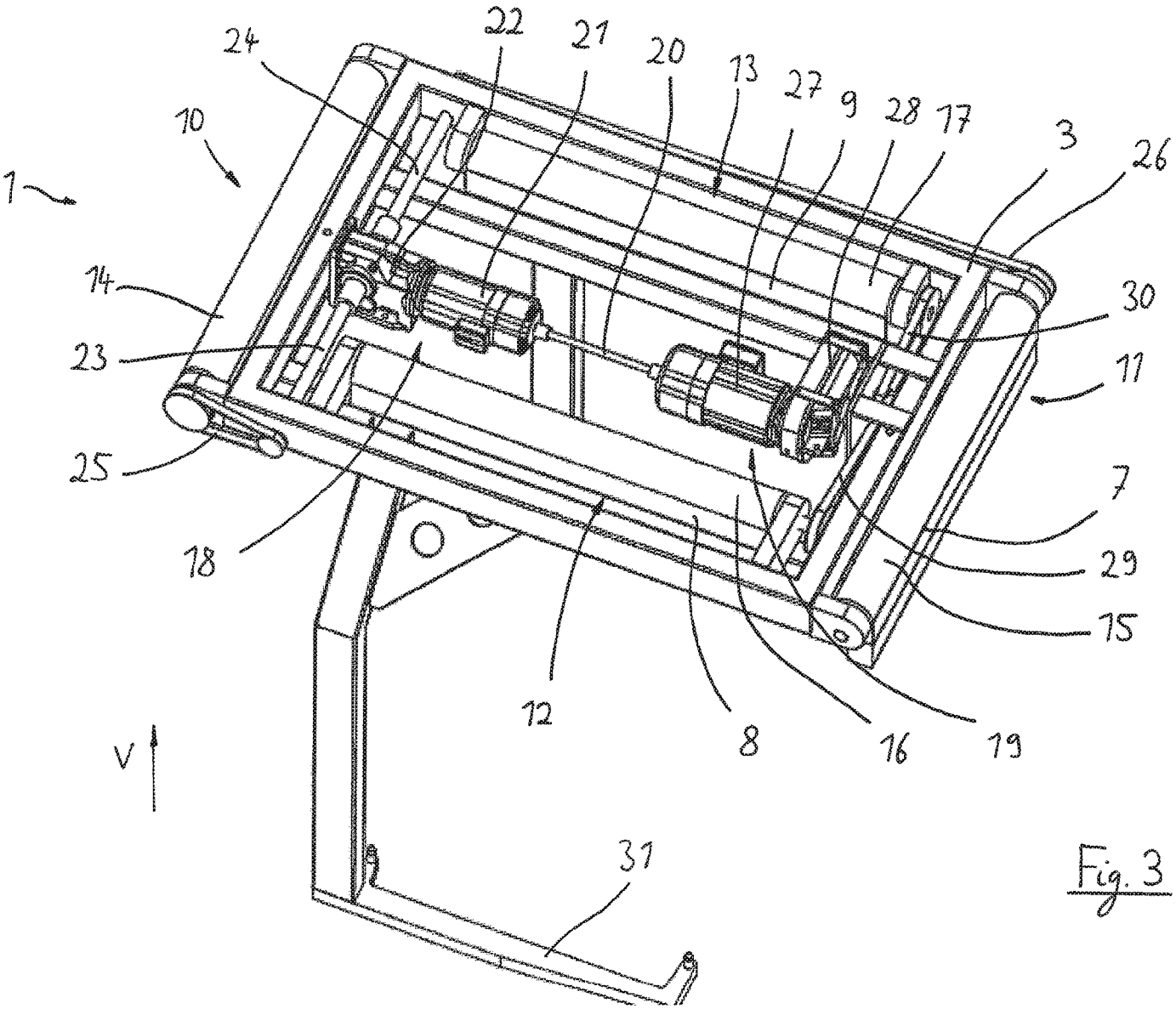
FIG. 3 shows in perspective view the lifting apparatus without path (rail) seen from an upper position.

Especially in the FIGS. 3 and 4 it can be seen how the rotary drive of the rollers 14, 15, 16, 17 takes place to influence the vertical height of the lifting element 4 by winding and winding-up respectively of the tension elements 6, 7, 8, 9.

Accordingly, a first drive 18 is provided which comprises a drive motor 21 which drives a conical gear mechanism 22. By the conical gear mechanism 22 two shafts 23 and 24 are driven by which in turn each one gear mechanism element 25 and 26 is driven; the gear mechanism elements 25, 26 are preferably chain or belt drives. Hereby the rollers 14 and 15 respectively are rotated synchronous.

Furthermore, a second drive 19 is provided which comprises a drive motor 27 by which a spur gear, a parallel-shaft gear or a planetary gear mechanism (all schematically indicated by 28) is driven. The spur gear 28 drives in turn two gear elements 29 and 30—again preferably designed as chain or belt drive—by which the rollers 16 and 17 are rotated synchronous.

The two drives 18 and 19 are again synchronized relative to another wherefore a synchronisation element 20 is provided. In the embodiment a shaft section is provided therefore which connects the two drive motors 21 and 27 with another so that their shafts can only be rotated synchronous.

Figure 5:
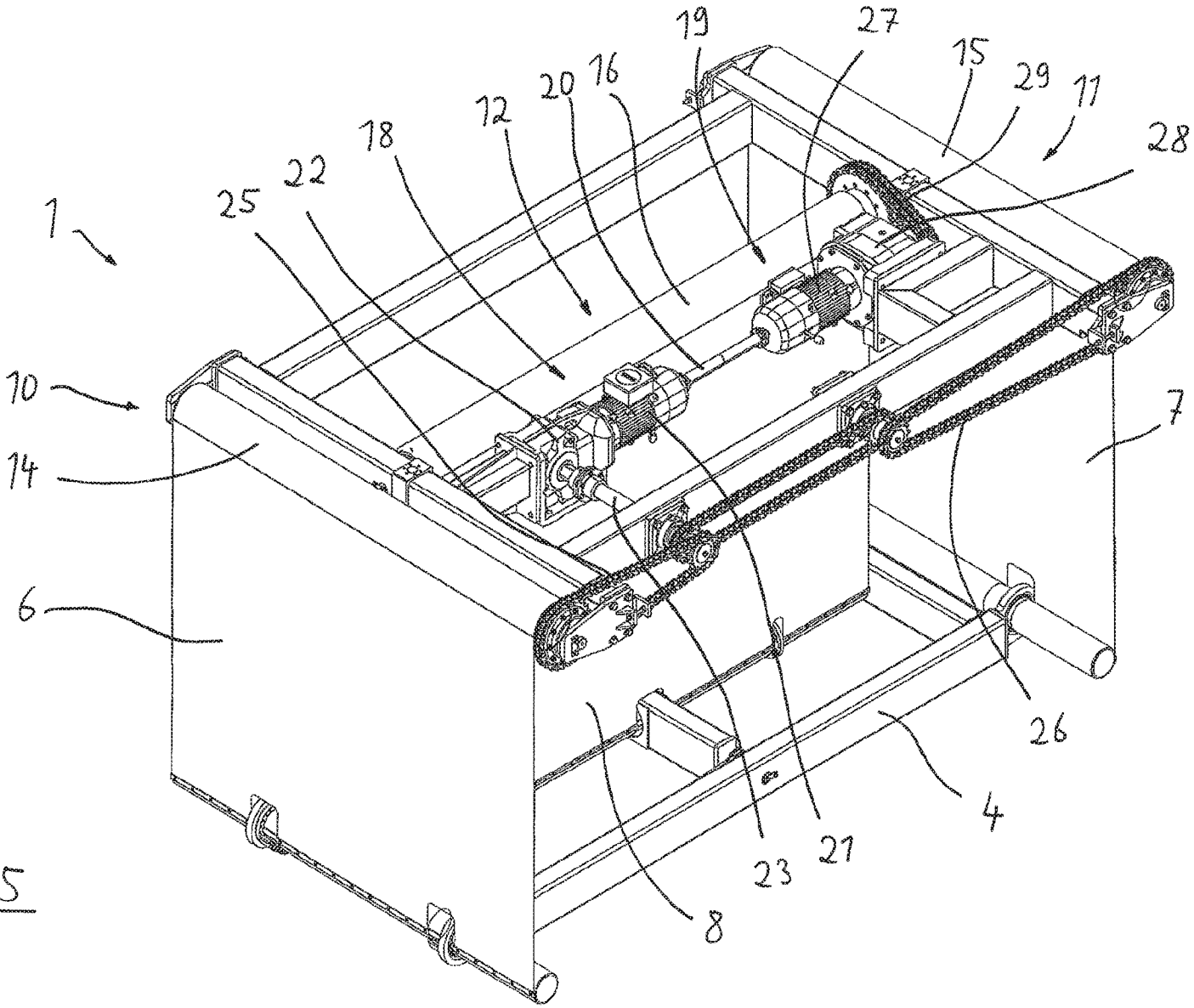
FIG. 5 shows in perspective view an alternative embodiment of the invention in the depiction according to FIG. 3.
Figure 6:
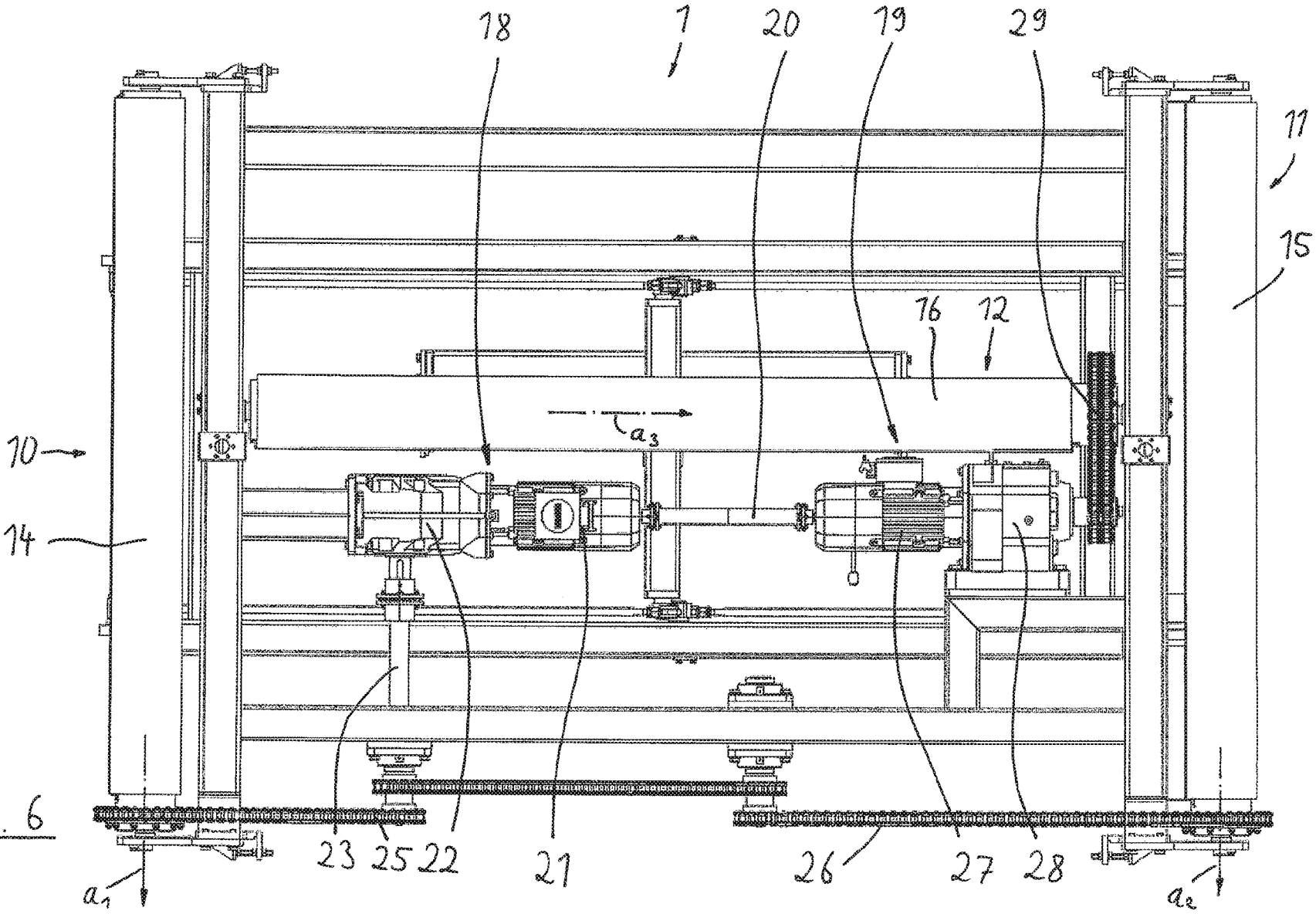
FIG. 6 shows the top plane view onto the arrangement according to FIG. 5.

In FIGS. 5 and 6 and alternative embodiment of the invention is shown. The difference to the above described solution is that here instead of four winding devices only three of them are provided, namely the winding devices 10, 11 and 12 with its respective rollers 14, 15 and 16. The axes of rotation $a_1$ and $a_2$ of the rollers 14 and 15 are parallel arranged to another; the axis of rotation $a_3$ of the roller 16 is arranged to them (in a top plan view) perpendicular so that a H-shaped structure for the three rollers 14, 15 and 16 is given when the same are viewed in the top plan view. Beside this the design corresponds to the above explained arrangement.

A special and subsequently described embodiment of the invention deals with a statically determined compensation of the length of the belts which can be provided as an option at the described elevating device.

The elevating device 1 (lifting hanger) consists—as explained—of the supporting carriage 3 (upper frame) and the lifting element 4 (lower frame). The lower frame is held by the tension elements 6, 7, 8, 9. To keep the lifting load as low as possible the winding devices are meaningful arranged in the upper frame 3. This means that the end fixation of the belts takes place at the lower frame 4. Different length of the belts can result due to tolerances of thickness of the tension elements (lifting belts), due to differences in the diameter of the winding drums, due to small errors in the transmission etc. Furthermore, it is complicated at the assembly to adjust the length of the belts in such a manner that a desired distribution of the load results.

The embodiment which is described subsequently ensures a predetermined distribution of load onto the tension elements, wherein small differences in the length of the tension elements can be equalized. Thereby, the fixation of the ends of the belts can take place by winding of several layers onto a roller as well as by forming of loops in the belts.

Figure 7:
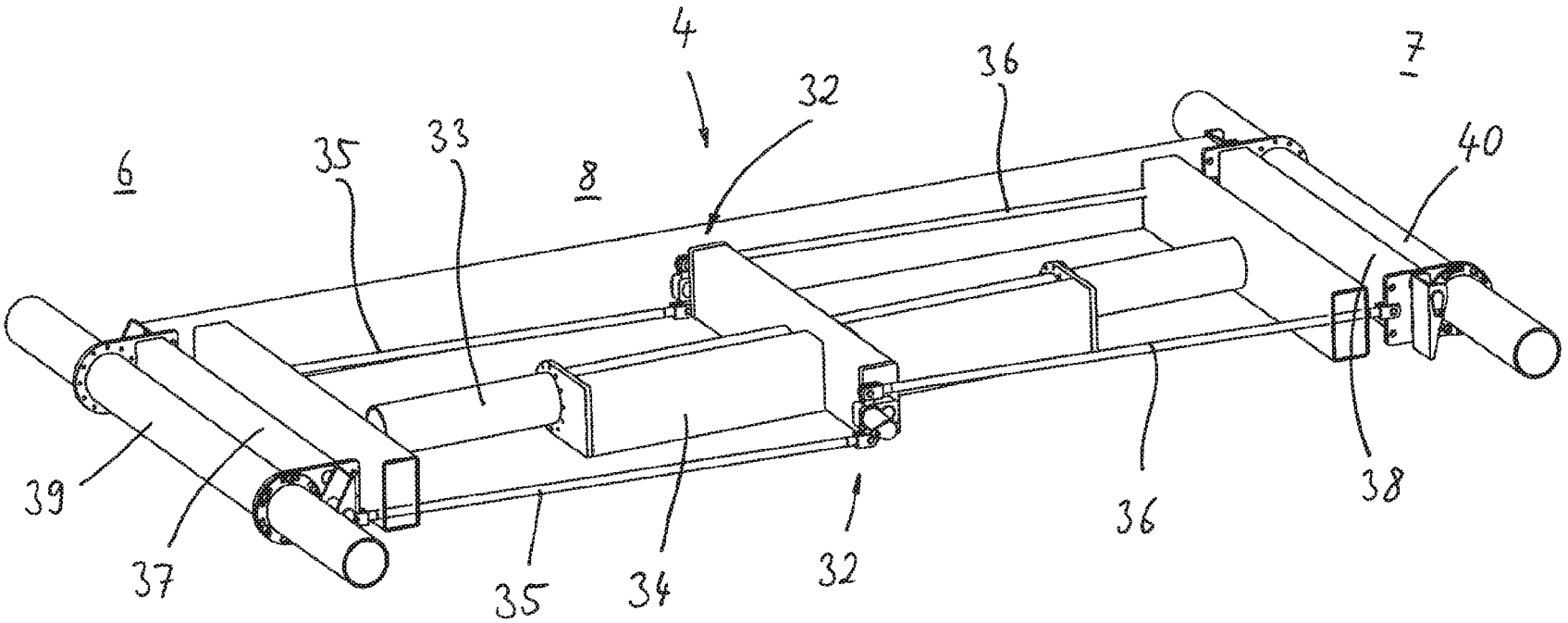
FIG. 7 shows in perspective view the lower frame of the lifting apparatus with a compensation of the length of the belt according to a first embodiment.
Figure 8:
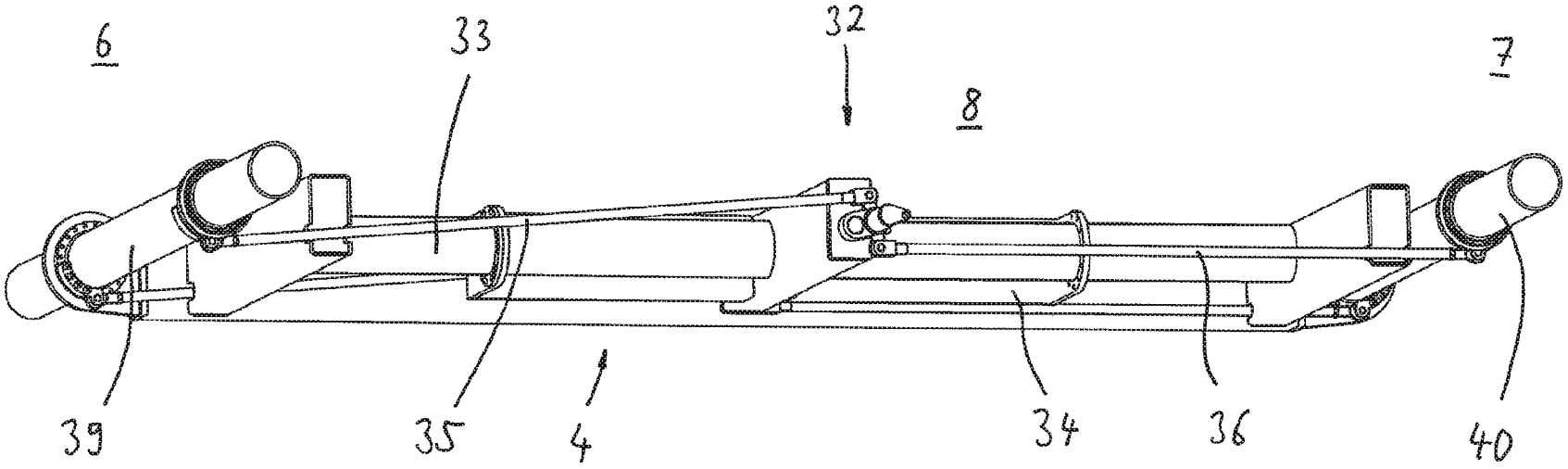
FIG. 8 shows in perspective view the lower frame of the lifting apparatus with a compensation of the length of the belt according to a second embodiment and FIG. 9 shows in perspective view a section of FIG. 7 and FIG. 8 respectively, wherein an eccentric is shown.
Figure 9:
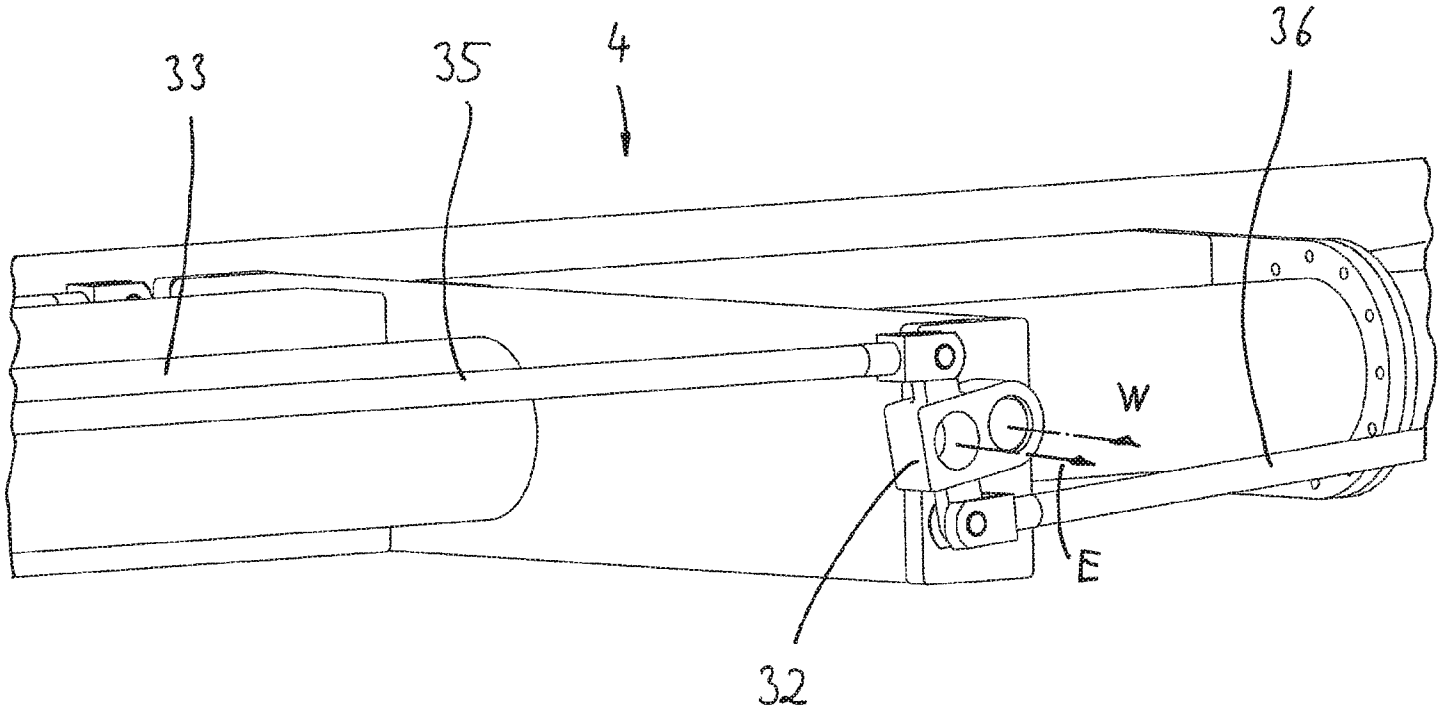

Specifically preferred are the two subsequently described alternative embodiments of said compensation of the length of the belts, The solution which is shown in FIG. 7 is subsequently denoted as type A, the solution which is shown in FIG. 8 is denoted as type B. In FIG. 9 a detail of the arrangement is shown. Thereby, the above described concept is provided in the FIGS. 7 to 9, wherein three tension elements 6 7, 8 (indicated in the FIGS. 7 and 8 only with respect to their location) are wound on rollers in H-shaped arrangement.

The solutions according type A and type B are not similarly suitable for both kinds of said end fixation of the belts. While type A can be employed at both kinds of end fixation of the belt the belt must in the case of type B mandatory be wound onto a rotatable end roll for the belt, Central elements of the compensation of the belt length are two eccentric 32 which are supported centrally in the lower frame 4. The end roll of belt 33 which is arranged longitudinally is supported in a rocker 34 which axis of rotation W is supported in the eccentric 32 eccentrically to the axis of rotation E of the same. Due to the tension force of the belt onto the longitudinally arranged end roll of belt 33 a left-turning torque results onto the eccentrics 32. This torque is in balance with a right-turning torque which is exerted by two tie rods 35, 36. Those tie rods 35, 36 are each connected either with two further rockers 37, 38 of the traverse arranged end rolls of belt 39, 40 (at type A according to FIG. 7) or directly with the rotatable arranged traverse arranged end rolls of belt 39, 40 (at type B according to FIG. 8). Dependent of the linkage of the tie rods 35, 36 at the eccentric 32 the direction of the torque can also act in the counter direction of the description (cf. FIG. 7 and FIG. 8).

Thereby the tension force of the tie rods 35, 36 increases proportionally with the tension force of the belts of the transversal belts 6, 7 and thus of the right-turning torque. On the other hand the left-turning torque is proportional to the tension force of the longitudinal belt 8 (see FIG. 5). Depending from the relationship of the levers the equilibrium of the eccentrics 32 is kept at a certain partition of the lifting load between the longitudinal belt 8 and the two transversal belts 6, 7. When the relationships of the levers are identical the longitudinal belt 8 receives the half lifting load. The other half is divided between the two transversal belts 6, 7.

By an enlargement of the eccentricity for example the load onto the longitudinal belt 8 decreases and the load onto the two transversal belts 6, 7 increases. So, for example a distribution of the tension force of 30% transversal/40% longitudinal/30% transversal can be pretended.

The required position of the eccentric 32 is given in the case that the axis of rotation E of the eccentric and the axis of rotation W of the rocker of the longitudinal arranged end roll of belt 33 lie in a horizontal plane. Small changes of the length of the belt at the winding process or due to different lengthening of the belt can be equalised by the eccentrics 32 by a small rotational movement. Thereby, the longitudinal arranged end roll of belt 33 and the two transversal arranged end rolls of belt 39, 40 behave antivalent. This means that a lengthening of the longitudinal belt 8 can be compensated by a right hand rotation of the eccentrics 32 what corresponds to a lifting movement of the end rolls of belt at the transversal belts 6, 7. Thereby, a new equilibrium can be reached by substantially keeping of the predetermined load distribution.

The rocker 37, 38 of the transverse arranged end roll of belt 39, 40 ensures that the longitudinal belt 8 is loaded symmetrically, even if for example the two transverse belts 6, 7 wind slightly asymmetrically or lengthen slightly different due to an asymmetric load distribution in longitudinal direction. Nevertheless, longitudinal forces which act onto the longitudinal belt 8 can be received via the transverse rigidity of the longitudinal belt.

By monitoring of the eccentric movement, e. g. by means of end switches, additional a break of the belt or a flabby belt can be detected, As can be seen from FIG. 7 for type A (with rockers for transverse rollers) the be rods 35, 36 are connected each with one rocker 37, 38 of the transverse rollers 39, 40. The transverse rollers are rotatable at the assembly process for winding the transverse belts. About three windings are normal to relieve via friction the fixation of the end of the belt at the end rolls of belt. After the assembly process the roller 39, 40 are firmly screwed with the rocker 37, 38, This design allows that the ends of the belt are fixed by means of several windings or via loops of the belt. The first maintains the whole strength of the belt while loops weaken the belt at the location of the connection (seam, damping).

As can be seen from FIG. 8 for type B (with rotatable transverse rollers) the tie rods 35, 36 are directly connected here with the rotatable supported transverse arranged end rolls of belt 39, 40. The tangentially arranged transverse belts exert so a torque onto the end rolls of belt. Those torques create each a tension force in the tie rods 35, 36.

LIST OF REFERENCES

1 Lifting apparatus
2 Track (rail)
3 Supporting carriage (upper frame)
4 Lifting element (lower frame)
5 Lifting device
6 Tension element (textile sheet, belt)
7 Tension element (textile sheet, belt)
8 Tension element (textile sheet, belt)
9 Tension element (textile sheet, belt)
10 Winding apparatus
11 Winding apparatus
13 Winding apparatus
13 Winding apparatus
14 Roller
15 Roller
16 Roller
17 Roller
18 First drive
19 Second drive
20 Synchronisation element
21 Drive motor of the first drive
22 Conical gear mechanism (bevel gear)
23 Shaft
24 Shaft
25 Gear mechanism element (belt drive/chain drive)
26 Gear mechanism element (belt drive/chain drive)
27 rive motor of the second drive
28 Spur gear
29 Gear element (belt drive/chain drive)
30 Gear element (belt drive/chain drive)
31 Hanger
32 Eccentric
33 End roll of belt (longitudinal)
34 Rocker
35 Tie rod
36 Tie rod
37 Rocker
38 Rocker
39 End roll of belt (transversal)
40 End roll of belt (transversal)
V Vertical direction
D Thickness
B Width
$a_1$ Axis of rotation
$a_2$ Axis of rotation
$a_3$ Axis of rotation
$a_4$ Axis of rotation
W Axis of rotation of rocker 34
E Axis of rotation of eccentric

The invention claimed is:

1. A lifting apparatus, comprising a support carriage which can be moved along a track, a lifting element for holding a load, a lifting device with which the lifting element can be raised and lowered in the vertical direction relative to the supporting carriage, wherein the lifting device comprises at least two tension elements, wherein each tension element is fixed with one end at the lifting element and at the supporting carriage and can be wound by means of each one winding apparatus onto the supporting carriage or onto the lifting element, wherein each tension element is designed as plane sheet and each winding apparatus comprises at least one roller by which the tension element can be wound, wherein each tension element comprises a thickness and a width, wherein the width is at least 100 times of the thickness, wherein at least one first winding apparatus and at least one second winding apparatus is given, wherein a roller of the first winding apparatus and a roller of the second winding apparatus have axes of rotation which are arranged perpendicular to another, wherein a first drive is present for driving of the at least one first winding apparatus and a second drive for driving of the at least one second winding apparatus, wherein the first drive comprises a drive motor which drives at least one shaft via a bevel gear, which shaft drives a roller of the first winding apparatus via a gear mechanism element and wherein the second drive comprises a drive motor which drives a roller of the second winding apparatus via a spur gear, a parallel-shaft gear or a planetary gear mechanism.

2. The lifting apparatus according to claim 1, wherein the width is at least 500 times of the thickness.

3. The lifting apparatus according to claim 1, wherein four winding apparatus are present, wherein respectively the roller of two winding apparatus have axes of rotation which are arranged parallel to another and wherein the axes of rotation of the rollers of two winding apparatus are perpendicular to the axis of rotation of the rollers of the two further winding apparatus.

4. The lifting apparatus according to claim 3, wherein the first drive for driving of two winding apparatus and the second drive for driving of two further winding apparatus are present.

5. The lifting apparatus according to claim 1, wherein three winding apparatus are present, wherein two rollers of the first and second winding apparatus have axes of rotation which are arranged parallel to another and the axis of rotation of the roller of the third winding apparatus is arranged perpendicular to the axis of rotation of the first and second winding apparatus.

6. The lifting apparatus according to claim 5, wherein the rollers of the first and second winding apparatus and the roller of the third winding apparatus form a H-shaped structure in the top plan view.

7. The lifting apparatus according to claim 1, wherein the tension elements consist of textile material or of metal or of a netting.

8. The lifting apparatus according to claim 1, wherein between the first drive and the second drive a synchronization element is arranged for a synchronal movement of the two drives.

9. The lifting apparatus according to claim 1, wherein the gear mechanism element is a belt drive or a chain drive.

10. The lifting apparatus according to claim 1, wherein the spur gear is a parallel-shaft gear.

11. The lifting apparatus according to claim 1, wherein between the spur gear and the roller of the second winding apparatus a gear element is arranged.

* * * * *